US005186186A

United States Patent [19]

Hamilton

[11] Patent Number: 5,186,186

[45] Date of Patent: Feb. 16, 1993

[54] MULTI-PURPOSE ORNAMENT AND METHOD OF USE IN RETAINING HAIR

[76] Inventor: Paul M. Hamilton, 15 Oak Ave., Newton, Mass. 02165

[21] Appl. No.: 833,635

[22] Filed: Feb. 7, 1992

Related U.S. Application Data

[63] Continuation of Ser. No. 640,265, Jan. 11, 1991, abandoned.

[51] Int. Cl.[5] ..... A45D 24/00

[52] U.S. Cl. ..... 132/200; 132/275

[58] Field of Search ..... 132/273, 275, 319, 312, 132/213, 214, 200; 63/11; 2/174, 198

[56] References Cited

U.S. PATENT DOCUMENTS

| | | | |
|---|---|---|---|
| 1,146,934 | 7/1915 | Gleeson | 132/273 |
| 1,183,108 | 5/1916 | Noyes | 132/278 |
| 1,283,358 | 10/1918 | Thompson | 2/174 |
| 2,011,194 | 8/1935 | Eisler | 132/273 |
| 2,076,358 | 4/1937 | Andrew | 132/273 |
| 2,618,274 | 11/1952 | Nell | 2/174 X |
| 2,666,923 | 1/1954 | Berg | 2/174 |
| 3,542,041 | 11/1970 | Mercorella | 132/273 X |
| 3,575,164 | 4/1971 | Heale | 132/273 X |
| 4,977,672 | 12/1990 | Hamilton | 30/233 |
| 4,998,544 | 3/1991 | Obergfell | 132/212 |

FOREIGN PATENT DOCUMENTS

| | | | |
|---|---|---|---|
| 0436894 | 11/1926 | Fed. Rep. of Germany | 132/275 |
| 0148282 | 1/1937 | Fed. Rep. of Germany | 2/198 |
| 0818984 | 10/1937 | France | 2/198 |

*Primary Examiner*—Gene Mancene
*Assistant Examiner*—Jeffrey A. Smith
*Attorney, Agent, or Firm*—Wolf, Greenfield & Sacks

[57] ABSTRACT

A multi-purpose device that can serve as a piece for retaining ponytails, braids and the like and as a body ornament is disclosed.

The multipurpose hair ornament includes a planar member for receiving the shaft of a cylindrical mass of hair or a body part. The body ornament also includes an elastic retainer member which releasably engages the body ornament to the mass of hair or the body part. The body ornament is made of a resilient material such as plastic which can be molded to fit the curvature of the hair or body part. The member is attached to the hair or body part by an elastic retainer which engages with two attachment points on the member.

15 Claims, 2 Drawing Sheets

MULTI-PURPOSE ORNAMENT AND METHOD OF USE IN RETAINING HAIR

This application is a continuation, of application Ser. No. 07/640,265, filed Jan. 11, 1991, now abandoned.

FIELD OF THE INVENTION

This invention pertains to hair ornaments and more particularly to a multi-purpose device that can retain ponytails, braids and the like and serve as a decoration.

BACKGROUND OF THE INVENTION

Body ornaments such as bracelets and necklaces and decorative hairstylings are extremely important to an individual s appearance. The adoption of long hair in the form of ponytails, braids and the like can be very desirable. Although ponytails or braids are typically held up by circular rubberbands, hair is often difficult to remove from the rubber band and can often become tangled within the elastic rubberband when trying to pull out the ponytail or braid through the rubber band loop.

SUMMARY OF THE INVENTION

It is an object of this invention to provide a multi-purpose ornament that can serve as an ornamental structure for gathering hair into a cylindrical mass such as ponytails, braids and the like.

It is another object of the invention to provide an improved device for retaining long hair in a defined pattern on a person's head without entangling the hair when the device is removed.

It is a further object of the invention to provide for this device to serve as a decoration for the arm, wrist, or other body part.

The invention includes a specially designed member for receiving the shaft of a cylindrical mass of hair. The member also includes a means for releasably engaging the hair to the member so that the cylindrical mass of hair is gathered in a stylish arrangement. A lock is provided that is used to hold the member tightly against a body part.

The planar member may optionally have defined within it an aperture in the shape of a preselected design. When an aperture is included in the member, it may be surrounded on all sides by the planar member.

The multi-purpose hair ornament is preferably made of a resilient material so that it can be molded to fit a cylindrical mass of hair or a body part. The member includes an elastic retainer that wraps around the hair shaft or body part and binds the hair or body part to the resilient member. A method of retaining a cylindrical mass of hair includes gathering the hair into a cylindrical mass, placing the mass in cooperation with the planar member, engaging the member to the hair by wrapping the elastic retainer around the hair, and locking the elastic retainer to the planar member.

DETAILED DESCRIPTION OF THE INVENTION

This invention pertains to a multi-purpose hair ornament that can also be used on a body part. The term "body part" is meant to include parts of the body such as fingers, wrists, and arms as well as hair. Preferably, the ornament is used as a hair-gathering piece for retaining a cylindrical mass of hair. When the ornament is released, the hair does not become entangled in rubber bands or other elastic straps. The invention can also serve as a body decoration such as an arm band or necklace. The term "cylindrical mass of hair" is meant to include hair arrangements such as ponytails, braids, twists, pigtails, and the like as these terms are known to those skilled in the art. When used as a body decoration, the device is preferably worn on the wrist as a bracelet or wrist band.

Figure 1:
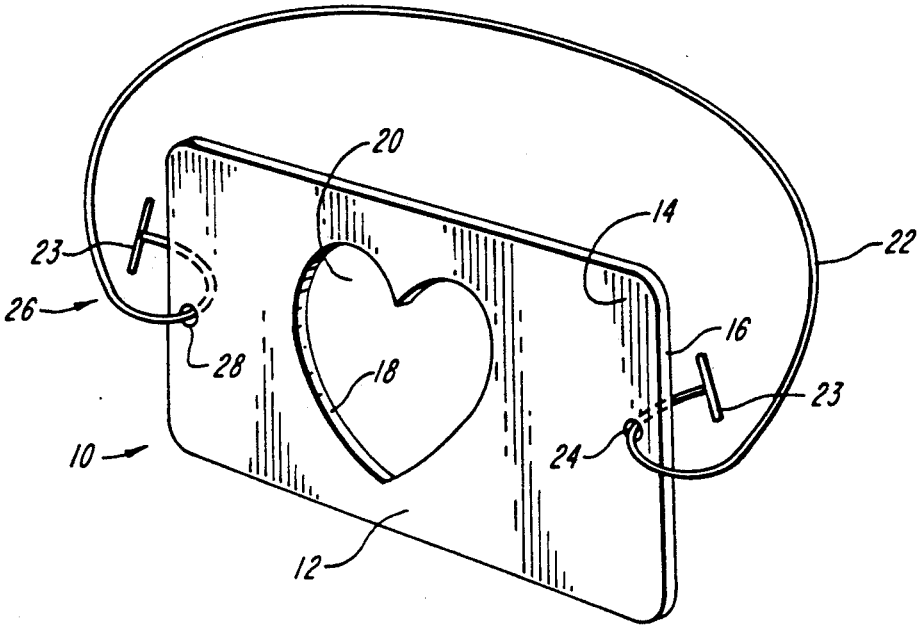
FIG. 1 illustrates a perspective view of a device of this invention.

FIG. 1 illustrates the multi-purpose hair ornament 10 of this invention. The ornament is formed of a planar member 12 having front 14, back 16, and finite thickness 18. As a hair-gathering and retaining piece, the ornament is bent to the curvature of the cylindrical mass of hair on which it is utilized. Member 12 is preferably fabricated from resilient polymers such as polyamide, polyacrylate, polypropylene, polystyrene, polyethylene, polytetrafluoroethylene, acrylic co-polymers with styrene and/or butadiene and the like. The size and thickness of member 12 can vary, depending upon the particular application. Member 12 varies in thickness from about 0.010 inches to about 0.080 inches (2.0 mm). Preferably, it is about 1/16 of an inch thick (1.58 mm).

The ornament includes a cut out section or aperture 20 defined within the planar member 12. Aperture 20 can be in any desired shape such as a heart, star or any other design. The aperture 20 functions both as a purely ornamental design and as a means for reducing the amount of solid material to enhance the flexibility of member 12. The aperture can be surrounded by the planar member 12 on all sides of the aperture as shown in FIG. 1.

A means for releasably engaging the cylindrical mass of hair onto the member is also included. The means comprises an elastic retainer 22 such as an elastic band or other stretchable piece that is affixed at one end to a position 24 on the outside periphery of the planar member 12. The other end of retainer 22 terminates in a loop or other arrangement 26 which is designed to engage with a lock 28 also affixed to the outer periphery of the planar member. Lock 28 is spaced apart at some distance away from the attachment position 24 for the elastic retainer. Preferably, lock 28 is affixed to the planar member on a side of the member opposite from the position 24 where the retainer is affixed. Lock 28 and attachment position 24 then define an axis A—A of member 12, as illustrated in FIG. 1. Lock 28 can be any arrangement that engages with the terminal end of the retainer. For example, if the terminal end of the retainer is a loop 26, the lock 28 can be a simple clip or slit shaped and sized to fit into the side of the planar member.

In the specific embodiment illustrated, both ends of retainer 22 are fitted to the center of a short, metal bar 23. Attachment position 24 is a hole defined within the planar member. Bar 23 can pivot about its center of attachment and, in its unmanipulated state, is maintained in a position substantially at right angles to the elastic retainer 22. The retainer is affixed to member 12 by manipulating bar 23 so that it can be threaded through attachment position 24. The other end of retainer 22 is engaged with an identical metal bar 23. Lock 28 is also a hole in member 12 through which the free end of retainer 22 is threaded.

Figure 2:
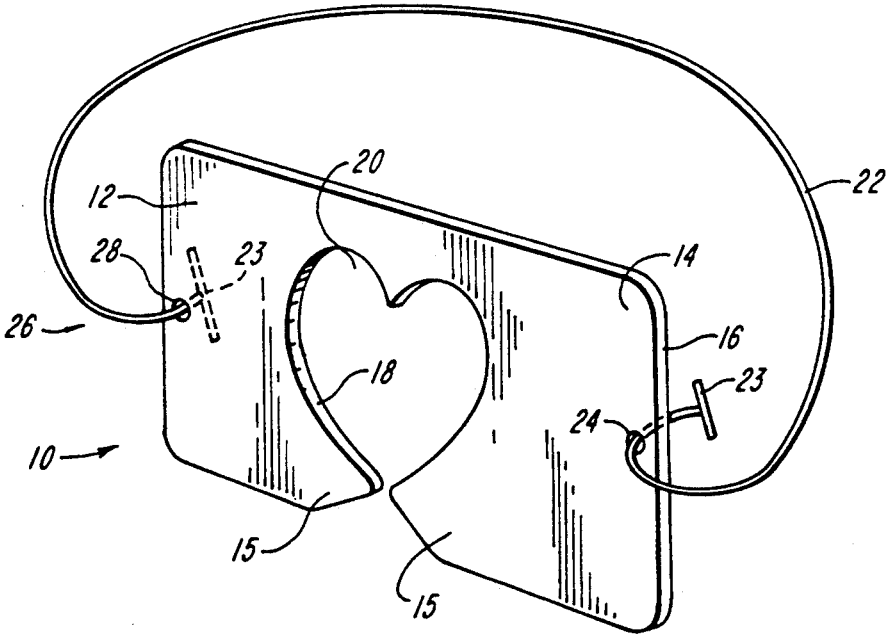
FIG. 2 illustrates a perspective view of a second embodiment of this invention.

FIG. 2, illustrates an alternate embodiment in which aperture 20 does not need to be surrounded on all sides by the planar member. Reference numbers are identical to those of FIG. 1 for clarity, except where indicated. This embodiment is particularly advantageous when the ornament is used as a hair-gathering device since there is a gripping surface 15 for the fingers which makes manipulation of the device easier.

Figure 3:
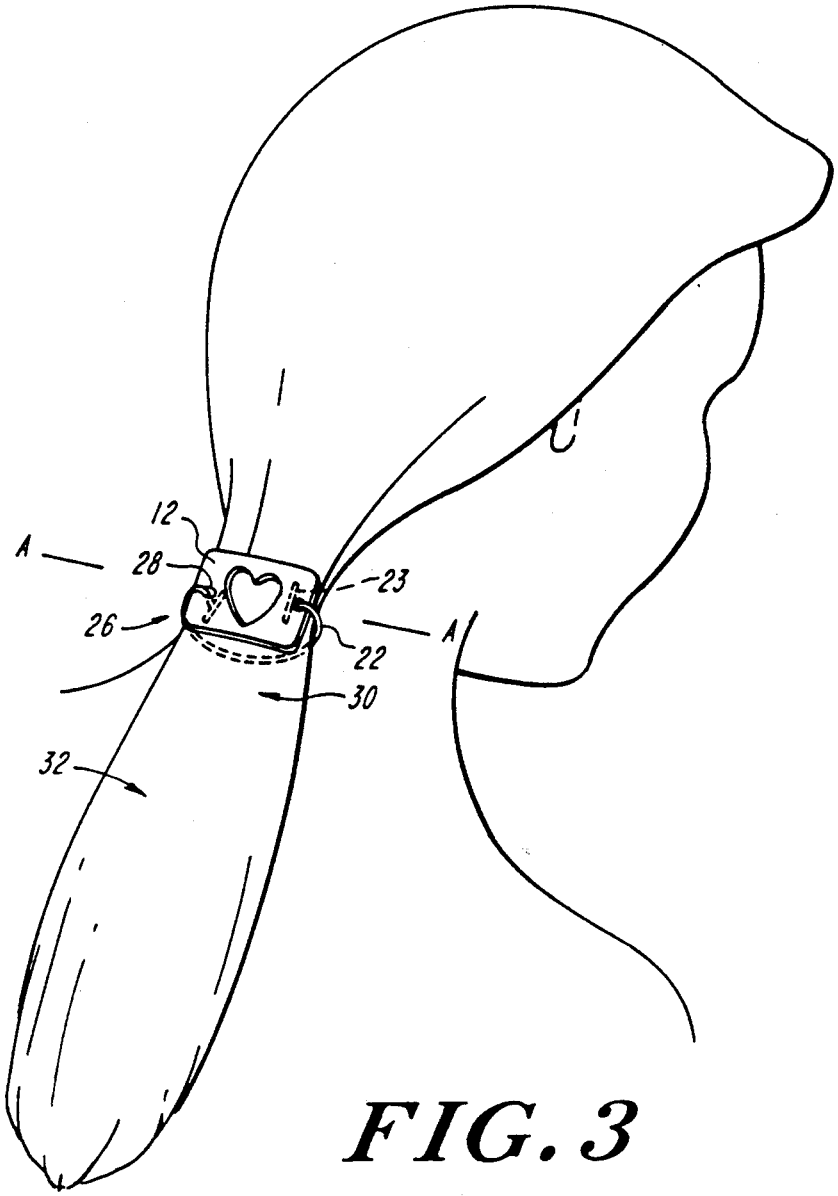
FIG. 3 illustrates a perspective view of a device of this invention in position on a person's head with the mass of hair being retained and locked into place.

FIG. 3 illustrates the ornament in use as a hair-gathering device. For clarity, reference numbers are identical to those in FIGS. 1 and 2 except where indicated. The shaft 30 of a cylindrical mass of hair 32 is gathered perpendicular to axis A—A of the planar member 12. The elastic retainer 22 is wrapped one or more times around the shaft of the hair and its free end 26 is locked into the planar member by threading metal bar 23 through lock 28 to retain the hair in place against the planar member. The number of wraps is determined by the thickness of the shaft of hair. Moreover, because retainer 22 is elastic, member 12 can be bound to the hair with any desired degree of tightness. The member can be adjusted at any distance along the cylindrical mass of hair although most preferably is disposed adjacent to the scalp.

The resilient nature of the planar member enables it to be shaped to fit the hair shaft. Member 12 can thus be formed substantially in a U-shape or inverted U shape in which the hair shaft is disposed within the curve of the U. To release the ornament, retainer 22 is removed from lock 28 and unwrapped to its full length. This procedure provides a convenient method of releasing the ornament without having to pull the entire length of a shaft of long hair through the circular opening of a rubber band.

Figure 4:
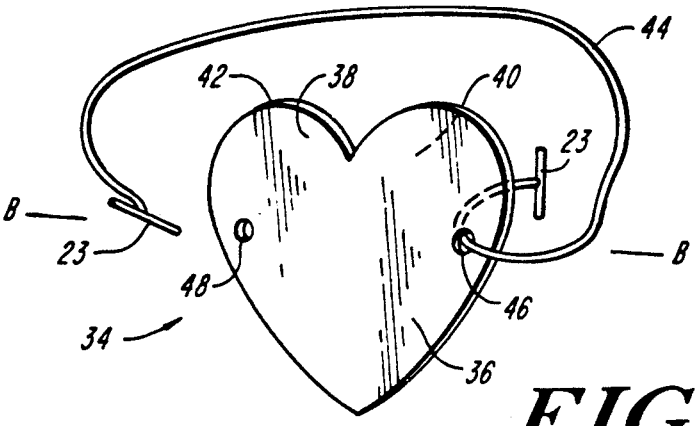
FIG. 4 illustrates a perspective view of a third embodiment of this invention.

FIG. 4 shows a third embodiment of the multi-purpose hair ornament of the invention used as a hair-gathering device 34 which includes a planar member 36 having a front 38, back 40 and finite thickness 42. The member 36 is shaped in a preselected design which can be in any desired shape such as a heart, star and the like. Planar member 36 is solid and can be made from the cut-out aperture of the piece embodied in FIG. 1.

An elastic retainer 44 is affixed at a first end to an attachment position 46 on the outer periphery of the planar member. A lock 48 is affixed to the planar member, preferably on a side opposite to that of the retainer 44, the attachment position 46 and locking means 48 defining an axis B—B, as shown. In the embodiment illustrated, retainer 44 terminates in metal bar 23, as described above in FIGS. 1 and 2. In use as a hair-gathering piece, axis B—B of the member is engaged perpendicular to the cylindrical mass of hair. The elastic retainer 44 is wrapped around the mass of hair one or more times and the free end thereof is locked into the planar member.

It will be readily appreciated by those skilled in the art that the use of this invention as a body decoration such as a bracelet is exactly analogous to its use as a hair-gathering piece. Referring again to the figures, the surface of a wrist, arm, or other body part is placed perpendicular to axis A—A and B—B of FIGS. 1 or 2 and 4, respectively. The piece is bent to the curvature of the particular body part on which it rests. The retainer 22,44 is wrapped one or more times around the body part and the free end of the retainer is engaged with the lock 28,48. The ornament is held against the body part in this manner and the number of wraps is determined by the thickness of the body part and the degree of retention desired.

Although the present invention has been described with reference to particular embodiments, it will be apparent to those skilled in the art that variations and modifications can be substituted therefor and not departing from principles and spirit of the invention.

I claim:

1. An ornament having multiple uses comprising a planar member for receiving a body part, the planar member having a front and back, said planar member defining a preselected design, an elastic retainer adapted to releasably engage at a first end thereof to said planar member by way of an elastic retainer mounting point, said elastic retainer for engaging the body part to the planar member; and a means spaced from said first end and affixed to said planar member for releasably engaging a second end of said elastic retainer to the planar member, wherein said elastic retainer mounting point and means spaced from said first end for releasably engaging a second end of said elastic retainer comprise first and second apertures defined in said planar member.

2. The ornament of claim 1, wherein the elastic retainer has a first end affixed to said planar member and wherein the locking means is affixed to said planar member and spaced from the first end of the elastic retainer, said locking means cooperating with a second end of the elastic retainer.

3. The ornament of claim 2, wherein the body part is a cylindrical mass of hair.

4. The ornament of claim 1, wherein each of said first and second ends of said elastic retainer terminating in a bar each of which extends through an aperture thereby releasably affixing said elastic retainer to said planar member.

5. An ornament having multiple uses, comprising a planar member for receiving a body part, the planar member having a front and a back, said planar member including a first aperture defined therein;

an elastic retainer having first and second ends that are adapted to releasably engage with the planar member, said elastic retainer engaged at the first end to said planar member; and means spaced from said first end and affixed to said planar member for releasably engaging the second end of said elastic retainer to the planar member, each of said first and second ends of said elastic retainer terminating in a bar each of which extends through an aperture, thereby releasably affixing said elastic retainer to said planar member.

6. The ornament of claim 5, wherein said first aperture is surrounded by said planar member on all sides.

7. The ornament of claim 5, wherein the body part is a cylindrical mass of hair.

8. A hair ornament for retaining a ponytail, comprising:

a planar member for receiving the ponytail, the planar member having a front and back and including a first aperture defined therein;

an elastic retainer for releasably engaging the ponytail to the planar ember, said elastic retainer including a first end adapted to releasably engage with said planar member at an elastic retainer mounting point; and means affixed to said planar member for releasably engaging a second end of said elastic retainer to said planar member, said means for releasably engaging and said elastic retainer mounting point defining an axis of said planar member, said axis aligned in a direction perpendicular to the ponytail, each of said first and second ends of said elastic retainer terminating in a bar, each of which extends through an aperture thereby releasably affixing said elastic retainer to said planar member.

9. The ornament of claim 8, wherein said means for releasably engaging is affixed to said planar member on a side of said planar member opposite said elastic retainer mounting point.

10. An ornament having multiple uses, comprising:

a planar member for receiving a body part, the planar member having a front and a back, said planar member including a first aperture defined therein;

an elastic retainer having first and second ends that are adapted to releasably engage with the planar member, said elastic retainer engaged at the first end to said planar member; and means spaced from said first end and affixed to said planar member for releasably engaging the second end of said elastic retainer to the planar member, wherein said means for releasably engaging the second end comprises said planar member having a second aperture defined therein.

11. A hair ornament for retaining a ponytail, comprising:

a planar member for receiving the ponytail, the planar member having a front and back and including a first aperture defined therein;

an elastic retainer for releasably engaging the ponytail to the planar member, said elastic retainer including a first end adapted to releasably engage with said planar member at an elastic retainer mounting point; and means affixed to said planar member for releasably engaging a second end of said elastic retainer to said planar member, said means for releasably engaging and said elastic retainer mounting point defining an axis of said planar member, said axis aligned in a direction perpendicular to the ponytail, wherein said elastic retainer mounting point and said means for releasably engaging said second end of said retainer comprise said planar member defining second and third apertures therein, said second and third apertures adapted to engage with respective ends of the retainer.

12. A method of retaining a ponytail, comprising:

gathering hair into a ponytail;

applying a planar member to the ponytail, the planar member comprising a front and a back, an elastic retainer adapted to releasably engage said planar member to the ponytail, the elastic retainer having a first end releasably mounted to said planar member at an elastic retainer mounting point, and a means for releasably engaging a second end of said elastic retainer to the planar member, said means for releasably engaging located on a side of said planar member spaced apart from said elastic retainer mounting point, said means for releasably engaging and said elastic retainer mounting point defining an axis of said planar member;

placing said ponytail in a direction substantially perpendicular to the axis of the planar member;

forming said planar member to an outer periphery of the ponytail;

engaging the planar member to the ponytail by wrapping said elastic member around the ponytail a number of times sufficient to bind the planar member to the ponytail; and locking the second end of said elastic retainer to the planar member.

13. The method of claim 12, wherein the step of locking the second end of the elastic retainer to the planar member comprises inserting the second end through the planar member having an aperture defined therein.

14. A method of retaining a cylindrical mass of hair, comprising gathering hair into a cylindrical mass;

placing the cylindrical mass in cooperating with a planar member, the planar member comprising a front and a back, an elastic retainer for releasably engaging said planar member to the cylindrical mass of hair, said elastic retainer having a first end adapted to releasably engage with said planar member, and a means on the planar member adapted to releasably engage a second end of said elastic retainer to the planar member;

engaging the planar member to an outer periphery of the cylindrical mass of hair by wrapping said elastic retainer around the cylindrical mass of hair a number of times sufficient to bind the planar member to the hair; and affixing said second end of said elastic retainer to the planar member.

15. The method of claim 14, wherein the step of affixing said second end comprises inserting the second end through said means adapted to releasably engage said second end, said means to releasably engage said second end comprising said planar member having an aperture defined therein.

* * * * *